US007010828B1

(12) United States Patent
Flores, Sr. et al.

(10) Patent No.: US 7,010,828 B1
(45) Date of Patent: Mar. 14, 2006

(54) TRI-JOINT GROOVER

(76) Inventors: Auden H. Flores, Sr., 8601 W. Ironwood Dr., Peoria, AZ (US) 85345; Michael L. Romero, 8601 W. Ironwood Dr., Peoria, AZ (US) 85345

( * ) Notice: Subject to any disclaimer, the term of this patent is extended or adjusted under 35 U.S.C. 154(b) by 340 days.

(21) Appl. No.: 10/457,991

(22) Filed: Jun. 11, 2003

(51) Int. Cl.
*E04G 21/20* (2006.01)
*E01C 23/02* (2006.01)

(52) U.S. Cl. ..... 15/235.3; 15/235.4; 425/458

(58) Field of Classification Search ..... 15/235.3, 15/235.4, 235.5, 235.6, 235.8; 425/458
See application file for complete search history.

(56) References Cited

U.S. PATENT DOCUMENTS

| | | | | | |
|---|---|---|---|---|---|
| 88,712 | A | | 4/1869 | Hogan | |
| 334,125 | A | * | 1/1886 | MacDonald | 15/235.3 |
| 1,021,557 | A | * | 3/1912 | Runner | 15/145 |
| 1,249,580 | A | | 12/1917 | Wilson | |
| 1,348,639 | A | * | 8/1920 | Grundmann | 15/235.3 |
| 1,763,066 | A | | 6/1930 | Rooney | |
| 3,729,765 | A | | 5/1973 | Peterson | |
| 4,399,583 | A | | 8/1983 | Jarvis | |
| 4,915,610 | A | * | 4/1990 | Curry | 425/458 |
| 5,393,168 | A | | 2/1995 | Jarvis | |
| 5,467,496 | A | * | 11/1995 | Jarvis | 15/235.8 |
| 5,632,569 | A | * | 5/1997 | Szmansky | 404/97 |
| 5,687,448 | A | * | 11/1997 | Dye, Jr. | 15/235.8 |
| 5,699,580 | A | * | 12/1997 | Silverstein | 15/235.7 |
| 6,138,318 | A | * | 10/2000 | Pyatt et al. | 15/235.4 |

* cited by examiner

*Primary Examiner*—Randall Chin

(57) ABSTRACT

A tri-joint groover or trowel assembly for finishing a concrete surface includes an elongate handle, a base member and a connector assembly for selectively connecting the handle to the base member. The base member has opposed edge portions and a centrally disposed longitudinal axis extending therebetween. The trowel assembly further includes an elongate track preferably having opposed sidewalls extending upwardly from the base member and extending along the longitudinal axis with the opposed sidewalls forming an opening therebetween. The base member includes a groove formed therein and substantially aligned with the opening of the track so that the connector assembly can be slidably moved therealong. The trowel assembly further includes an elongate grooving member integral with the connector assembly and extending substantially parallel to the opposed edge portions and downwardly from the base member with the grooving member being slidably movable along the groove.

19 Claims, 5 Drawing Sheets

TRI-JOINT GROOVER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a trowel and, more particularly, to a trowel including a selectively adjustable grooving member disposed therebeneath.

2. Prior Art

Numerous styles of concrete trowels and other accessories for use in finishing concrete have been available upon the market for some time. In many instances, these tools are useful for accomplishing their intended results, but lacking certain refinements that would make them highly efficient in usage for affording frequent consistency in the high quality finishing needed for freshly poured concrete.

Many of the prior art assemblies are cumbersome and awkward to assemble and disassemble. Many are simply too heavy for commercial use. Others utilize interlocking components and structures which fail, or can be operated, if at all, only with great effort, when they are damaged or become fouled in customary use. Others call for the handling and manipulation at the job site and under less than favorable conditions of small, easily lost, difficult to operate parts and hardware.

For example, U.S. Pat. No. 3,936,210 to Oehlerking discloses one such concrete finishing tool, wherein the float member has a handle attached to it, and also provides a removable type accessory for use in furnishing a groove upon the finished concrete surface. U.S. Pat. No. 1,295,735 to Grundmann discloses another form of a concrete finishing tool having a groover integrally molded upon the tool's body portion. In addition, U.S. Pat. No. 1,273,060 to Hoff discloses a concrete edging and marking tool that includes in combination various structural means for adding to the thickness and size in addition to location of the groover formed upon the tool's bottom surface.

Other designs may operate well at the outset, but wear poorly and become unusable with use. Still others are so complex and cumbersome that they are impractical for commercial use. Additionally, assemblies of this type are relatively costly to fabricate, and many have a tendency to deteriorate with wear and exposure. Some of the prior art devices employ constructions which, while useful for a specific purpose or with a particular combination of handle and blade, do not lend themselves to other uses, or other combinations.

Because of their potential utility and the demand for them, the development of trowel assemblies has been active and extensive. Despite these efforts, however, heretofore no single trowel assembly has been produced or disclosed which avoids the aforementioned deficiencies. Accordingly, there remains a need for a trowel including an adjustable grooving member.

BRIEF SUMMARY OF THE INVENTION

In view of the foregoing background, it is therefore an object of the present invention to provide a tri-joint groover or trowel assembly including an adjustable grooving member. These and other objects, features, and advantages of the invention are provided by a tri-joint groover or trowel assembly for finishing a concrete surface, which includes an elongate handle, a base member and a connector assembly for selectively connecting the handle to the base member. The base member has opposed edge portions and a centrally disposed longitudinal axis extending therebetween. The opposed edge portions of the base member may extend upwardly therefrom.

The trowel assembly further includes an elongate track preferably having opposed sidewalls extending upwardly from the base member and extending along the longitudinal axis with the opposed sidewalls forming an opening therebetween. The base member includes a groove formed therein and substantially aligned with the opening of the track so that the connector assembly can be slidably moved therealong.

The trowel assembly further includes an elongate grooving member integral with the connector assembly and extending substantially parallel to the opposed edge portions and downwardly from the base member with the grooving member being slidably movable along the groove. The trowel assembly further includes a plurality of fastening members for selectively fastening the connector assembly along the track and for selectively fastening the connector assembly.

The connector assembly preferably includes an upper member including a threaded hollow portion for receiving the handle therein and a lower member removably connected to the upper member and disposed onto the sidewalls of the track. The lower member may be preferably formed to be substantially t-shaped.

The upper member may further include a toothed portion and the lower member may further include a toothed portion for interlocking with the upper member toothed portion and for assisting to maintain same at a stationary position. The grooving member preferably has a substantially planar surface for assisting to form a substantially smooth groove into a concrete surface. The track and the groove each have spaced end portions respectively with the grooving member preferably being movable between the spaced end portions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime notations are used to indicate similar elements in alternate embodiments.

Figure 5:
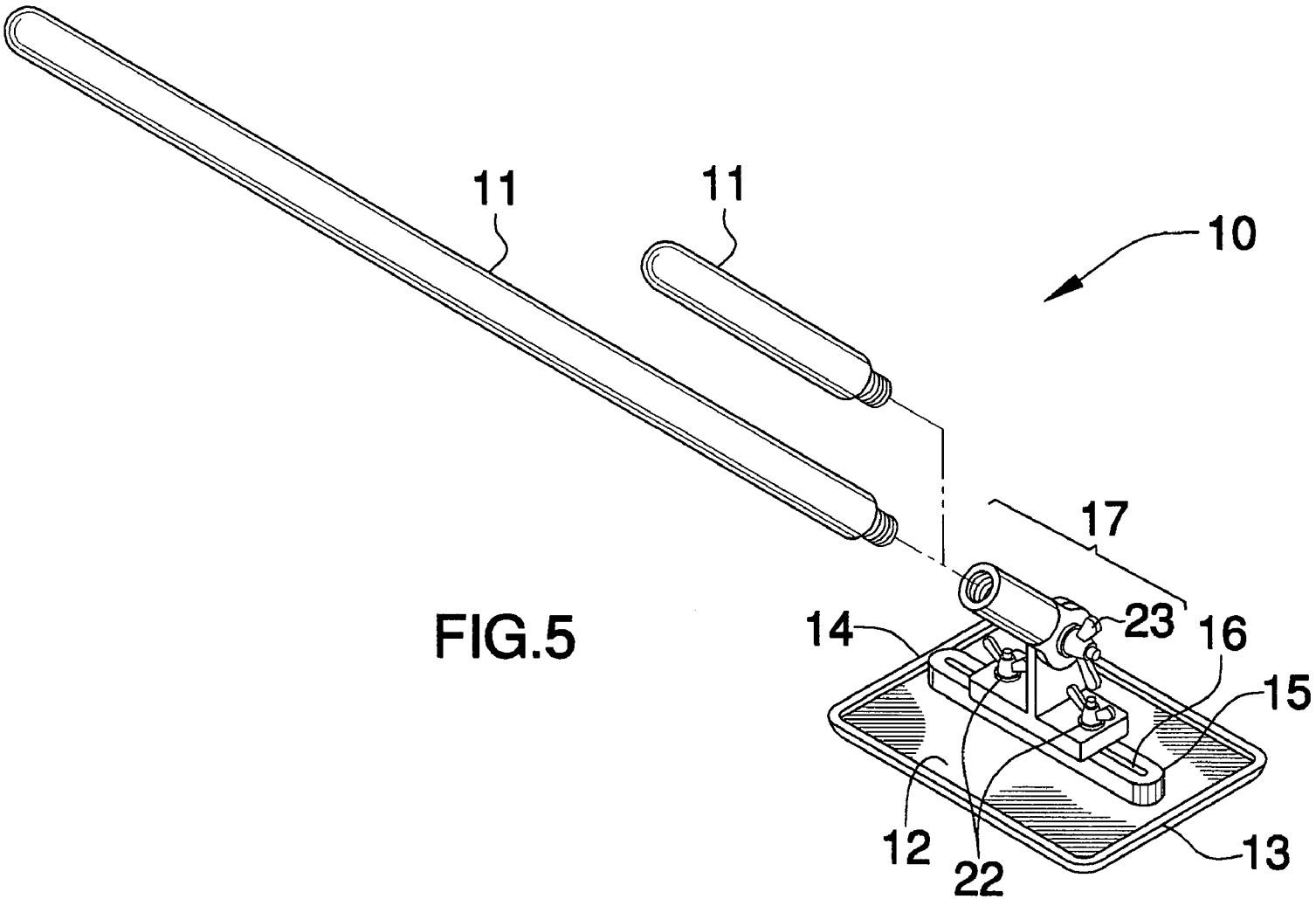
FIG. 5 is an exploded, perspective view of the present invention including various shaped handles.

The tri-joint groover or trowel assembly of this invention is referred to generally in FIG. 5 by the reference numeral 10 and is intended to smoothen and create grooves in concrete surfaces, especially around pillars (now shown). It should be understood that the trowel assembly 10 may be used to groove different types of concrete surfaces and should not be construed as limited to only grooving concrete surfaces around pillars.

The trowel assembly 10 includes an elongate handle 11 or 11' removably connectable to a connector assembly 17, which is attachable to a track 15 extending upwardly from base 12. It should be noted that the elongate handles 11 and 11' may have a length of a few feet up to as many as 15 or more feet. In addition, additional segments of the handle 11, 11' may be engaged together, in a manner as known in the arts, to supplement the length of the handle 11, 11' during its intended application.

The base member 12 has a generally rectangular shape and substantially planar upper and lower surfaces with opposed edge portions 13, 14 extending upwardly therefrom the upper surface. Base member 12 is a unitary, one-piece member. Track 15 has opposed sidewalls which are substantially planar and extend upwardly between opposed edge portions 13, 14. The track 15 has an opening 16 formed therein for defining the lateral movement of the connector assembly 17 attached thereto.

Base member 12 has a central longitudinal axis extending between opposed edge portions 13, 14 and along the opening 16 in a parallel manner. A plurality of fasteners 22, 23 help maintain the connector assembly 17 at a stationary position and connected to track 15 as well as for connecting the members of connector assembly 17 to one another (as discussed hereinbelow).

Figure 1:
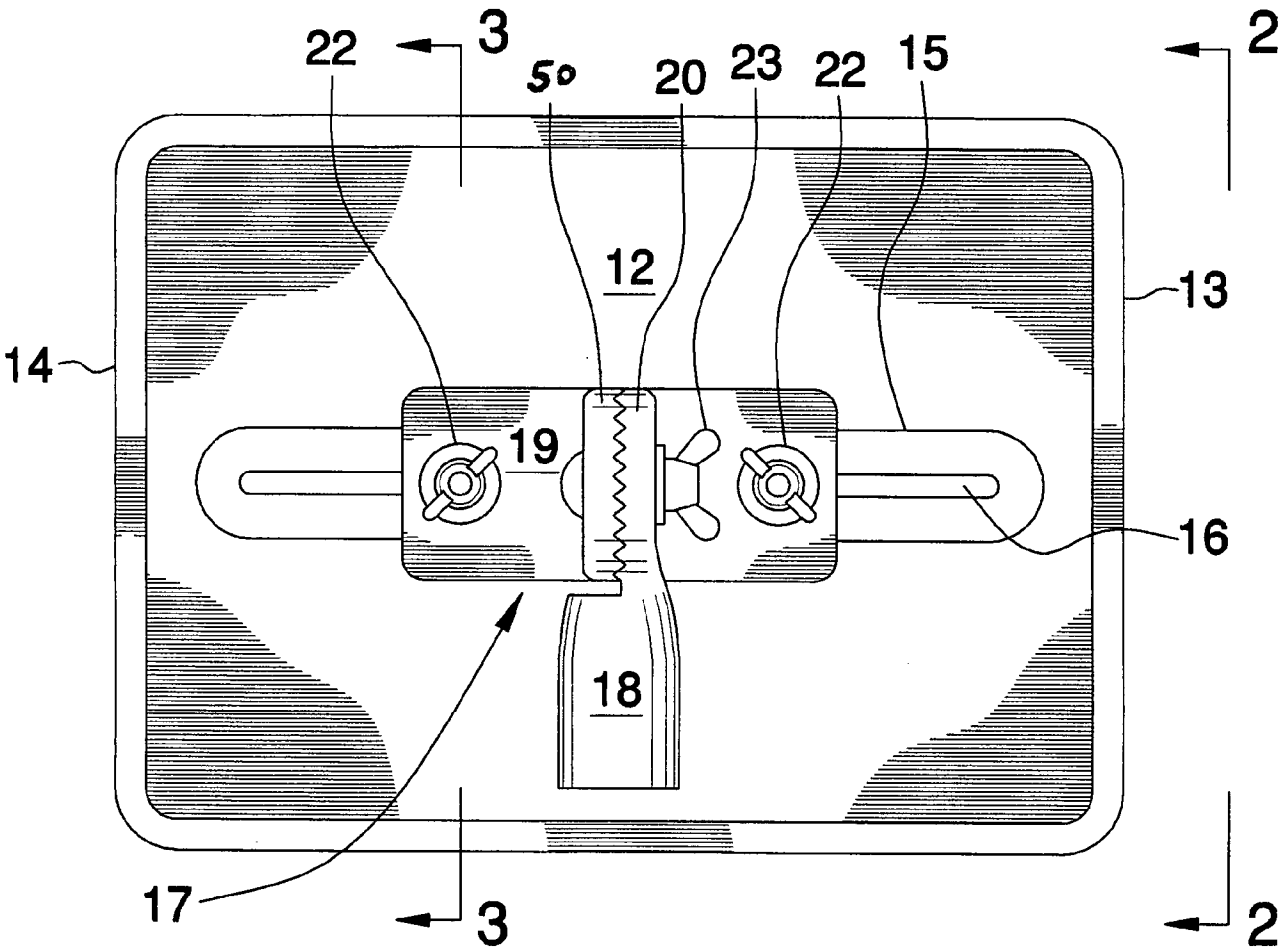
FIG. 1 is a top plan view of a tri-joint groover or trowel assembly, in accordance with the present invention.

Now referring to FIG. 1, a top plan view of the base member 12 is shown with connector assembly 17 attached thereto. As discussed above, track 15 is substantially parallel and extends between opposed edge portions 13, 14. The connector assembly 17 is connected to track 15 by securely fastening fastener members 22 within the opening 16 of track 15. The connector assembly 17 includes an upper member 18 connected to a lower member 19 by fastener member 23. Of course, such fastening members 22, 23 may be conventional wing nuts with corresponding bolts as well known in the industry. Other suitable fastening members such as screws may also be employed for allowing the connector assembly to be selectively and removably positioned along track 15.

The upper member 18 of the connector assembly 17 includes a toothed end portion 20 integral therewith. Likewise, the lower member 19 of the connector assembly 17 includes a corresponding toothed end portion 50 for engaging and locking with the upper member toothed end portion 20 and for helping to selectively maintain the upper member 18 at a stationary position with respect to lower member 19.

Figure 2:
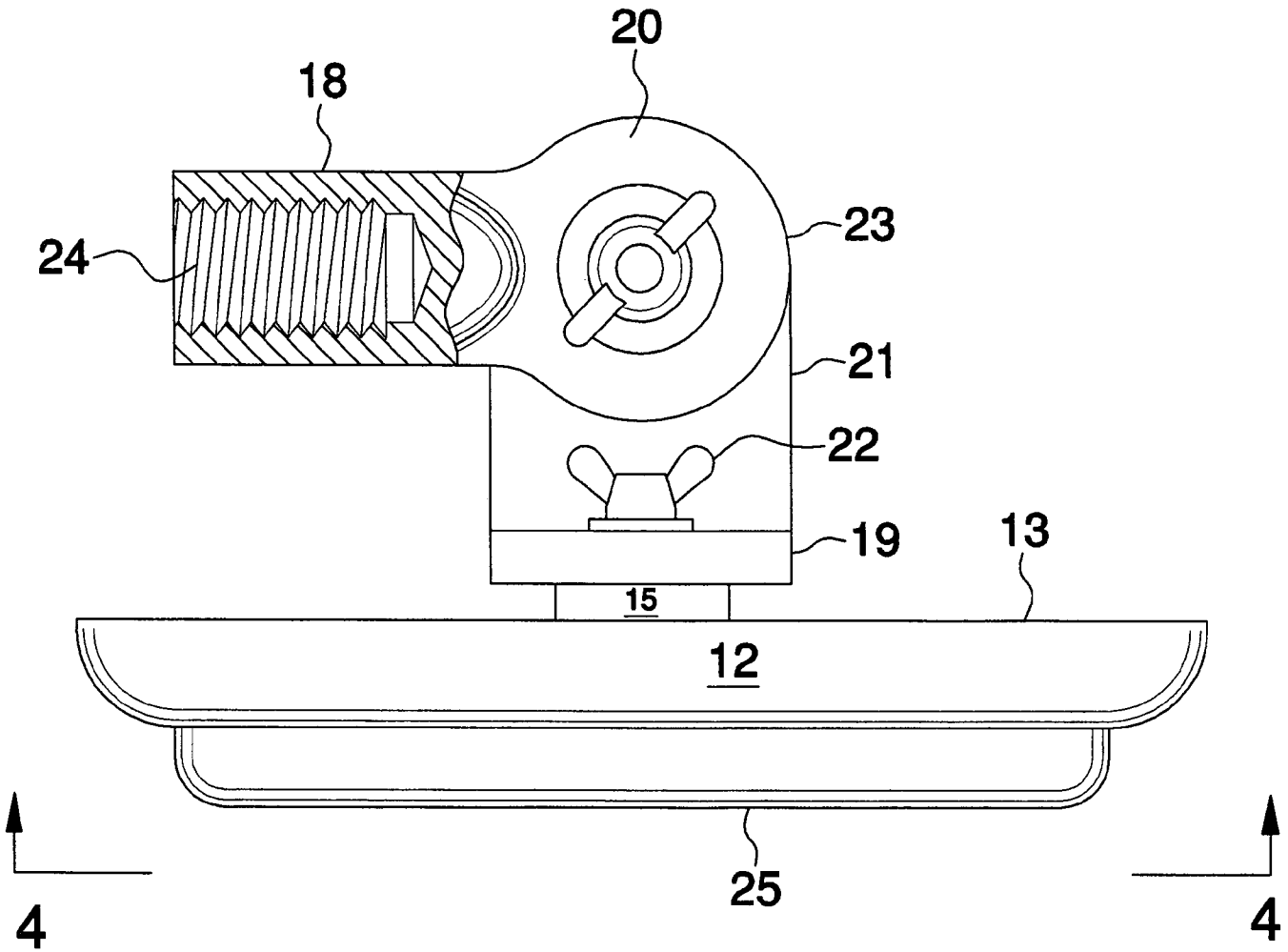
FIG. 2 is side-elevational view taken along line 2—2 and showing a partial cross-section thereof.

Now referring to FIG. 2, upper member 18 is shown as having a threaded hollow portion 24 for receiving a corresponding threaded end portion of a conventional handle 11, 11'. The lower member 19 has a substantially planar portion resting on top of track 15 and a substantially vertical portion 21 extending upwardly therefrom. In particular, track 15 is shown as being disposed below the connector assembly 17 and integral with base member 12 for allowing the connector assembly 17 to slidably move along its opening 16.

Notably, a grooving member 25 extends downwardly from base member 12 and is integral with the connector assembly lower member 19. Such a grooving member 25 extends substantially parallel and between opposed edge portions 13, 14 and substantially perpendicular to the opening 16 of track 15. The grooving member 25 preferably has substantially planar surfaces that converge toward each other at a lower portion thereof and for assisting to create a smooth and clean groove in a surface of wet concrete.

Figure 3:
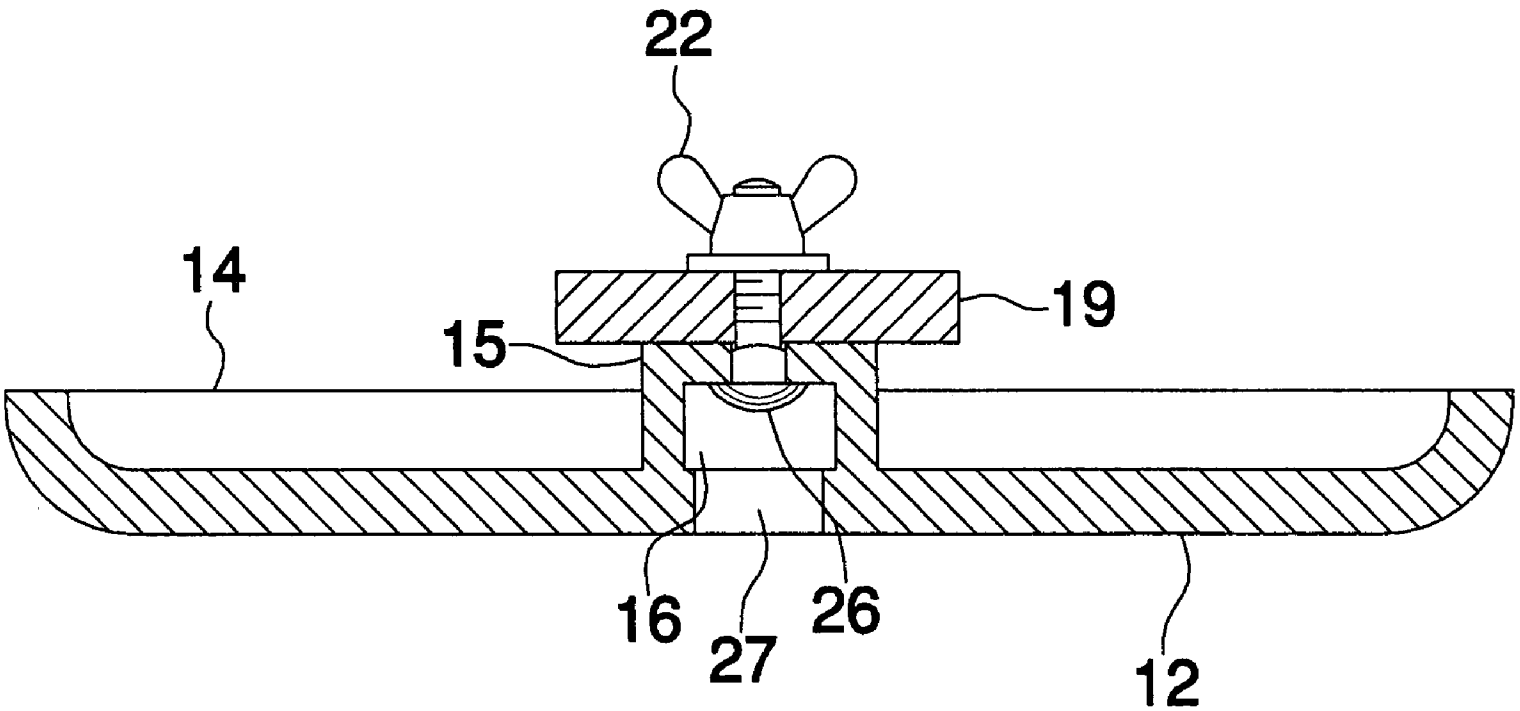
FIG. 3 is a cross-sectional view taken along line 3—3 thereof.

Now referring to FIG. 3, base member 12 is shown as being integral with track 15 with same extending upwardly therefrom and above outer edge portions 13, 14. Fastening member 22 passes through an aperture formed generally medially within lower member 19 and extends downwardly into the opening 16 of track 15. In particular, bolt head 26 is positioned and engaged within the interior of track 15 such that when fastener member 22 is tightened, the lower member 19 becomes securely attached to track 15. The opening 16 is integral with and cooperates with groove 27 formed within base member 12 and substantially aligned therewith. Such a groove 27 has a width, which is preferably narrower than the width of opening 16, and extends from a bottom of opening 16 downwardly to the bottom surface of base member 12.

Figure 4:
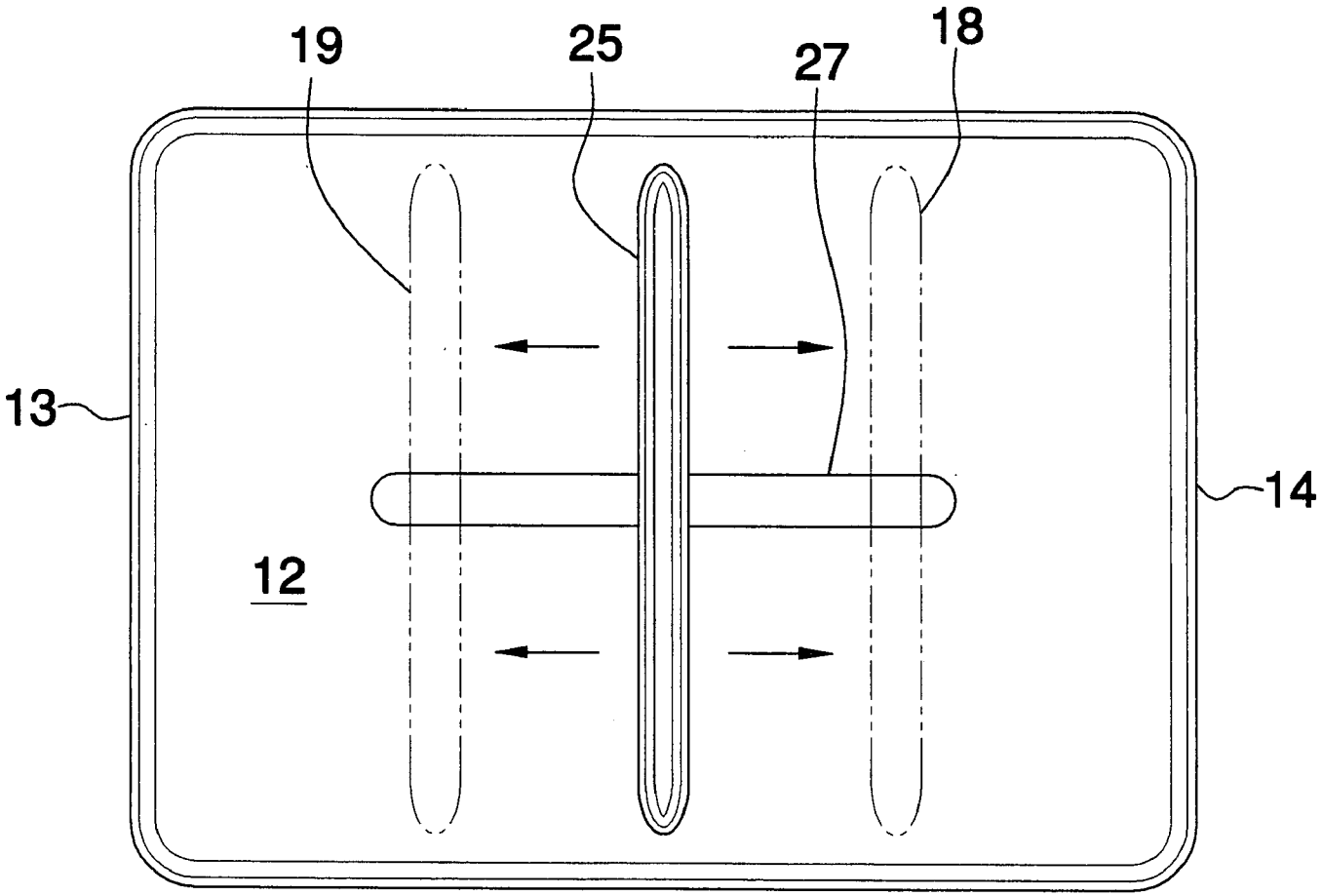
FIG. 4 is a bottom plan view taken along line 4—4 and showing an adjustable grooving member.

Referring to FIG. 4, a bottom surface of base member 12 is shown as being substantially planar for contacting and smoothly finishing a surface of wet concrete while grooving member 25 forms a groove therein. All of base member 12 is shown in the illustrations as generally flat. However, base member 12 can be formed to be slightly convex to help prevent the development of any vacuum suction when the base member 12 is glided over wet concrete.

Moreover, grooving member 25 can be selectively positioned along groove 27 and between lateral positions 28, 29, as clearly shown. Advantageously, a groove may be formed on the surface of wet concrete by selectively positioning the grooving member 25 to the desired position. Such selective positioning helps to effectively eliminate the need for an operator to exert unnecessary effort especially when performing grooves around pillars (not shown), as well known to a person a ordinary skill in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A trowel assembly for finishing a concrete surface and comprising:

an elongate handle;

a base member and a connector assembly for selectively connecting said handle to said base member, said base member having opposed edge portions and a centrally disposed longitudinal axis extending therebetween;

an elongate track having opposed sidewalls extending upwardly from said base member and extending along the longitudinal axis, the opposed sidewalls forming an opening therebetween, said base member having a groove formed therein and substantially aligned with the opening of said track so that said connector assembly can be slidably moved therealong;

an elongate grooving member integral with said connector assembly and extending substantially parallel to the opposed edge portions and downwardly from said base member, said grooving member being slidably movable along said groove; and a plurality of fastening members for selectively fastening said connector assembly along said track and for selectively fastening said connector assembly.

2. The trowel of claim 1, wherein said connector assembly comprises:

an upper member including a threaded hollow portion for receiving said handle therein; and a lower member removably connected to said upper member and disposed onto the sidewalls of said track.

3. The trowel of claim 2, wherein said lower member is formed to be substantially t-shaped.

4. The trowel of claim 2, wherein said upper member further includes a toothed portion and said lower member includes a toothed portion for interlocking with said upper member toothed portion and for assisting to maintain same at a stationary position.

5. The trowel of claim 1, wherein the opposed edge portions of said base extend upwardly from a perimeter thereof.

6. The trowel of claim 1, wherein said grooving member has a substantially planar surface for assisting to form a substantially smooth groove into a concrete surface.

7. The trowel of claim 1, wherein said track and said groove each have spaced end portions respectively with said grooving member being movable between said spaced end portions.

8. A trowel assembly for finishing a concrete surface and comprising:

an elongate handle;

a base member and a connector assembly for selectively connecting said handle to said base member, said base member having opposed edge portions and a centrally disposed longitudinal axis extending therebetween, said connector assembly comprising an upper member including a threaded hollow portion for receiving said handle therein and a lower member removably connected to said upper member;

an elongate track having opposed sidewalls extending upwardly from said base member and extending along the longitudinal axis, the opposed sidewalls forming an opening therebetween, said base member having a groove formed therein and substantially aligned with the opening of said track so that said connector assembly can be slidably moved therealong;

an elongate grooving member integral with said connector assembly and extending substantially parallel to the opposed edge portions and downwardly from said base member, said grooving member being slidably movable along said groove; and a plurality of fastening members for selectively fastening said connector assembly along said track and for selectively fastening said connector assembly.

9. The trowel of claim 8, wherein said lower member is formed to be substantially t-shaped.

10. The trowel of claim 8, wherein the opposed edge portions of said base extend upwardly from a perimeter thereof.

11. The trowel of claim 8, wherein said upper member further includes a toothed portion and said lower member includes a toothed portion for interlocking with said upper member toothed portion and for assisting to maintain same at a stationary position.

12. The trowel of claim 8, wherein said grooving member has a substantially planar surface for assisting to form a substantially smooth groove into a concrete surface.

13. The trowel of claim 8, wherein said track and said groove each have spaced end portions respectively with said grooving member being movable between said spaced end portions.

14. A trowel assembly for finishing a concrete surface and comprising:

an elongate handle;

a base member and a connector assembly for selectively connecting said handle to said base member and for adjustably positioning said handle along a first plane, said base member having opposed edge portions and a centrally disposed longitudinal axis extending therebetween;

an elongate track having opposed sidewalls extending upwardly from said base member and extending along the longitudinal axis, the opposed sidewalls forming an opening therebetween, said base member having a groove formed therein and substantially aligned with the opening of said track so that said connector assembly can be slidably moved therealong in a second plane;

an elongate grooving member integral with said connector assembly and extending substantially parallel to the opposed edge portions and downwardly from said base member, said grooving member being slidably movable along said groove; and a plurality of fastening members for selectively fastening said connector assembly along said track and for selectively fastening said connector assembly;

said track and said groove each have spaced end portions respectively with said grooving member being movable between said spaced end portions.

15. The trowel of claim 14, wherein said connector assembly comprises:

an upper member including a threaded hollow portion for receiving said handle therein; and a lower member removably connected to said upper member and disposed onto the sidewalls of said track.

16. The trowel of claim 15, wherein said lower member is formed to be substantially t-shaped.

17. The trowel of claim 15, wherein said upper member further includes a toothed portion and said lower member includes a toothed portion for interlocking with said upper member toothed portion and for assisting to maintain same at a stationary position.

18. The trowel of claim 14, wherein the opposed edge portions of said base extend upwardly from a perimeter thereof.

19. The trowel of claim 14, wherein said grooving member has a substantially planar surface for assisting to form a substantially smooth groove into a concrete surface.

* * * * *